United States Patent [19]

Spielman

[11] 4,062,343

[45] Dec. 13, 1977

[54] TUBE FIRING BURNER

[75] Inventor: Lyle S. Spielman, Rockford, Ill.

[73] Assignee: Eclipse, Inc., Rockford, Ill.

[21] Appl. No.: 685,887

[22] Filed: May 12, 1976

[51] Int. Cl.[2] ..... F24C 3/00

[52] U.S. Cl. ..... 126/91 A; 431/353

[58] Field of Search ..... 126/91 A; 431/284, 285, 431/158, 353

[56] References Cited

U.S. PATENT DOCUMENTS

| | | | |
|---|---|---|---|
| 3,418,060 | 12/1968 | Spielman et al. | 431/158 |
| 3,832,991 | 9/1974 | Schlosser | 126/91 A |
| 3,884,215 | 5/1975 | Schlosser | 126/91 A |
| 4,003,692 | 1/1977 | Moore | 431/158 |

*Primary Examiner*—Edward G. Favors
*Assistant Examiner*—R. J. Charvat
*Attorney, Agent, or Firm*—Leydig, Voit, Osann, Mayer & Holt, Ltd.

[57] ABSTRACT

A tube has one end portion supported within an opening in a heat-insulating wall and is fired by a dual fuel burner. Disposed within the one end portion of the tube is a combustion sleeve which extends the flame of the burner inwardly beyond the wall and thereby prevents the insulated end portion of the tube from being burned out. An abrupt restriction is formed at the discharge end of the combustion sleeve and creates turbulence in the air/fuel mixture to promote cleaner and more efficient burning.

4 Claims, No Drawings

TUBE FIRING BURNER

BACKGROUND OF THE INVENTION

This invention relates to a flame-producing burner for firing a tube. Such a tube may, for example, be a ceramic or alloy tube of the type used to heat a kiln, a heat treating furnace, a lehr or the like. In such an instance, one end portion of the tube may be disposed in an opening in a heat-insulating wall. Alternatively, the tube may be an immersion tube which is submerged within a tank of liquid in order to heat the liquid. The latter tube may have a return portion for exhausting the products of combustion from the liquid or the products of combustion may be exhausted through the liquid itself.

In some respects, the burner of the present invention is similar to that disclosed in Spielman et al U.S. Pat. No. 3,418,060. Such a burner includes a tubular burner body which houses a fuel supply pipe that extends through the closed end of a cup adapted to form combustion air into a tubular stream prior to primary mixing of the air with the fuel.

In other respects, the present burner is similar to the burner disclosed in Moore United States application Ser. No. 602,248, filed Aug. 6, 1975 and assigned to the assignee of the present invention. That burner is of the dual fuel type and is adapted to burn either fuel oil or gas.

SUMMARY OF THE INVENTION

The primary aim of the present invention is to provide a new and improved tube firing burner, preferably of the dual fuel type, which extends its flame well into the tube so as to avoid excessive heating and burn-out of that end portion of the tube which is adjacent the burner and which sometimes is surrounded by a heat-insulating wall.

A further object of the invention is to provide a burner which is capable of firing initially cold tubes such as liquid-surrounded tubes without generating any significant amount of smoke or carbon within the tube.

Still another object is to provide a dual fuel tube firing burner which has the ability to operate with low excess combustion air without smoking or sooting, which maintains better flame stability over a wide range of air/fuel ratios, which has greater turn-down capability than conventional dual fuel burners, and which produces better temperature profiles within the tube.

The burner of the invention is particularly characterized by the provision of a unique combustion sleeve which is located within the tube to extend the flame well into the end portion of the tube, the combustion sleeve being kept cool by the tubular stream of combustion air and serving to create turbulence in the air/fuel mixture so as to retard smoking and promote better flame retention.

These and other objects and advantages of the invention will become more apparent from the following detailed description when taken in conjunction with the accompanying drawings.

DETAILED DESCRIPTION OF THE PREFERRED EMBODIMENT

Figure 1:
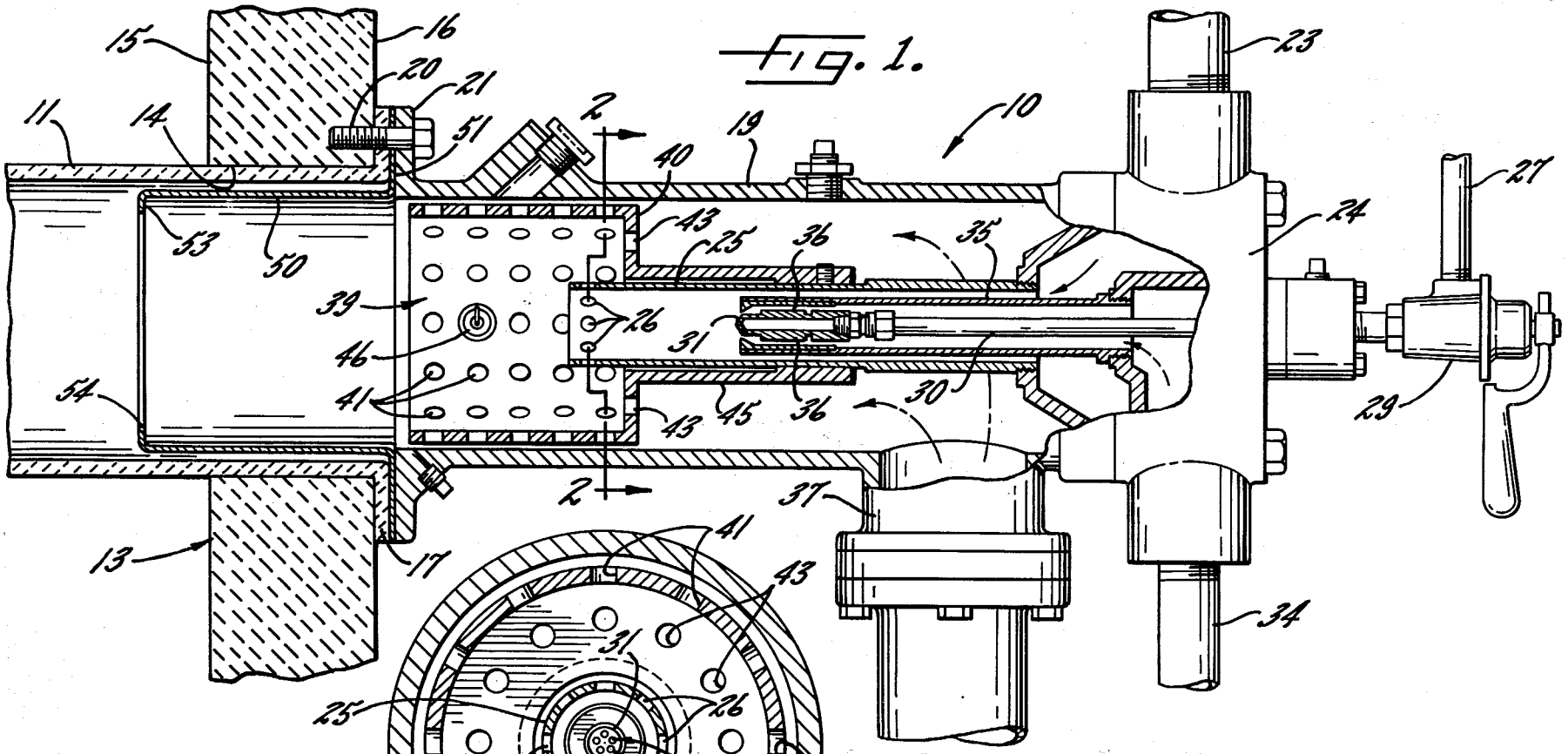
FIG. 1 is a side elevation of a tube firing burner incorporating the novel features of the present invention and shows the burner in conjunction with an exemplary tube, portions of the view being broken away and shown in section.

As shown in the drawings for purposes of illustration, the invention is embodied in a burner 10 for firing a tube 11 which, in the disclosed embodiment, is a cylindrical ceramic tube of the type used in a kiln or other heat treating furnace. One wall 13 of the furnace is shown in FIG. 1 and is made of brick or other refractory material capable of withstanding high temperatures and insulating the heating chamber of the furnace. One end portion of the tube is telescoped into an opening 14 formed in the wall and extending between the inner and outer sides 15 and 16 thereof, the tube having a flange 17 located adjacent the outer side of the wall. Combustion of an air/fuel mixture within the tube raises the temperature thereof so that heat is transferred by radiation and/or convection to the work being processed in the furnace.

The burner 10 comprises a tubular body 19 made of cast iron and fastened at its inner end to the outer side 16 of the wall 13 by screws 20 extending through a mounting flange 21 on the inner end of the body and also extending through the flange 17. Gaseous fuel may be supplied to the burner through a line 23 and is delivered into a housing 24 which is attached to the outer end of the body 19. The gas flows out of the housing and into a gas supply pipe 25 whose outer end is fastened to the outer end of the body and whose inner discharge end is open and is formed with a series of angularly spaced holes or ports 26.

Figure 2:
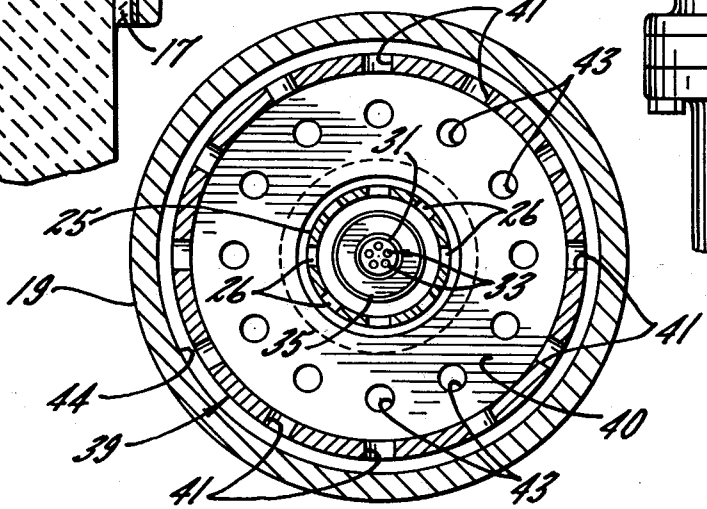
FIG. 2 is an enlarged cross-section taken substantially along the line 2—2 of FIG. 1.

As an alternative to gas operation, the burner 10 may be selectively operated on fuel oil. For this purpose, oil is adapted to be delivered to the burner by way of a line 27 and an adjustable control valve 29 and flows through the housing 24 through a small diameter tube 30. The tube is located within the gas supply pipe 25 and is connected at its inner end to an oil nozzle 31 which is formed with angularly spaced holes 33 (FIG. 2).

In order to break the oil up into small droplets, atomizing air is delivered into the housing 24 through a line 34 (FIG. 1) and flows through a tube 35 which is telescoped into the gas pipe 25 and over the oil tube 30. Just prior to leaving the tube 35, the atomizing air encounters and is spun by helically extending and circumferentially spaced vanes 36 formed around the outside of the oil nozzle 31. The spinning atomizing air is discharged adjacent the holes 33 in the oil nozzle and causes the oil to be transformed into a fine mist. The oil nozzle is located well short of the inner end of the gas supply pipe 25 and thus the oil mist passes within and ultimately is discharged out of the pipe.

Air for supporting combustion of the fuel is supplied by a blower (not shown) and is delivered into the burner body 19 through a radially extending pipe 37. Such air flows inwardly along the exterior of the fuel supply pipe 25 and then encounters a cylindrical cup 39 which forms the air into a tubular stream. As shown, the cup is located with its open end adjacent the outer end of the opening 14 in the wall 13 and with its closed end 40 disposed outwardly of the discharge end of the fuel pipe 25. Axially spaced rows of circumferentially spaced holes 41 are formed through the cylindrical wall of the cup 39 while holes 43 arranged in a circumferentially extending row are formed through the closed end 40 of the cup. The cup is centered within the burner body 19 and is somewhat smaller in diameter than the body so that an annular gap 44 is left between the body and the cup to allow a tubular stream of combustion air to flow past the cup. A tubular extension 45 is formed integrally with the closed end of the cup and is telescoped over and fastened to the fuel pipe 25 to support the cup within the body 19. Also, a spark plug 46 is supported by the body 19 and is located with its electrodes positioned within the cup so as to provide a spark for initially igniting the air/fuel mixture in the cup.

In accordance with the present invention, a combustion sleeve 50 is located adjacent the open end of the cup 39 and serves to extend the flame of the burner 10 well into the radiant tube 11 so that the flame will not directly contact and damage that end portion of the tube which is disposed within the opening 14 and which is insulated by the refractory wall 13. Moreover, the combustion sleeve serves to create turbulence in the air/fuel mixture being discharged from the cup 39 and into the tube 11 so as to maintain good flame retention and to promote clean burning even if the mixture contains little or no excess air.

More specifically, the combustion sleeve 50 is generally cylindrical and is made of stainless steel or other material capable of withstanding high temperatures. The sleeve is telescoped into the inner end portion of the tube 11 and includes an outer flange 51 which is sandwiched between the flanges 17 and 21, the sleeve being held in place by the screws 20. Importantly, the sleeve 50 is spaced radially inwardly from the tube 11 and thus is not in conductive contact with the tube. Also, the sleeve is at least sufficiently long to project the flame front beyond the inner side 15 of the wall 13. To accomplish this, the sleeve of the preferred embodiment projects inwardly a substantial distance beyond the inner side of the wall as shown in FIG. 1. In keeping with the invention, the sleeve is of substantially uniform diameter throughout its length except at the extreme inner end of the sleeve. There the sleeve is bent inwardly to form an abrupt or sharp-edged annular restriction 53 so that a reduced diameter discharge opening 54 is defined at the end of the sleeve.

With the foregoing arrangement, most of the combustion air supplied through the pipe 37 passes over the cup 39 and through the gap 44 and thus is formed into a tubular stream which flows along the interior wall of the sleeve 50 and keeps the sleeve relatively cool. Some of the combustion air, however, passes into the cup 39 through the holes 41 and 43 and mixes with a small amount of fuel which escapes into the cup through the holes 26 in the fuel pipe 25. This air/fuel mixture is ignited by the spark plug 46 to create a pilot flame. At all airflow rates within the range of the burner 10, the air/fuel ratio of the mixture in the cup 39 is within combustible limits and thus the pilot flame is maintained continuously during operation of the burner.

When the burner 10 is being operated on gas, most of the gas is discharged out of the extreme inner end of the fuel pipe 25 and passes out of the open end of the cup 39 to mix with the tubular air stream flowing past the cup and into the sleeve 50. Accordingly, the most intense flame is produced adjacent and beyond the inner end of the sleeve 50 and thus the sleeve extends the flame inwardly beyond the inner end portion of the tube 11. As pointed out above, the tubular air stream scrubs the interior wall of the sleeve to keep the latter relatively cool and this, together with the fact that the sleeve is spaced radially inwardly from the tube 11, helps avoid the application of extremely high temperatures to the inner end portion of the tube. Thus, the inner end portion of the tube is not likely to burn out even though it is insulated by the refractory wall 13 and is not capable of readily losing heat.

When the burner 10 is being operated on oil, the spinning atomizing air passing by the vanes 36 creates a vortex which acts on hot gases from the pilot flame in the cup 39 and pulls such gases reversely into the fuel pipe 25. These recirculated hot gases cause vaporization of part of the oil being sprayed from the nozzle 31 and provide retention for the flame which starts burning within the pipe 25.

The air/fuel mixture being discharged from the sleeve 50 encounters the abrupt restriction 53 at the inner end of the sleeve and thus is rapidly contracted and formed into a turbulent flow. This turbulence causes recirculation of hot gases within the radiant tube 11 and such recirculation assists in vaporizing the oil so as to provide for clean burning of the oil even though only little excess air is present in the mixture. Accordingly, combustion of a mixture containing little or no excess air may occur without creating any significant amount of carbon or smoke within the tube 11.

From the foregoing, it will be apparent that the present invention brings to the art a new and improved burner 10 having a unique combustion sleeve 50 which serves a twofold purpose. First, the sleeve extends the flame inwardly beyond the wall 13 so as to prevent burn-out of the end portion of the tube 11 and to produce a better temperature profile along the tube. Secondly, the turbulence imparted to the fuel/air mixture by the restriction 53 promotes cleaner and more efficient burning of the fuel within the tube. It has been found that the present burner can start liquid-surrounded tubes without creating significant amounts of smoke or carbon and that the burner possesses better flame stability and greater turndown ability than the dual fuel burners which are presently available.

I claim:

1. The combination of, a heat-insulating wall having inner and outer sides and having an opening extending between said sides, a radiant tube projecting inwardly from the inner side of said wall and having an outer portion disposed within the full length of said opening, and a burner for firing said tube and having a tubular body secured to the outer side of said wall and located in substantially coaxial relation with said tube, a fuel delivery pipe extending into said body from the outer end portion thereof, means for supplying a flow of fuel through said pipe, means for supplying a flow of combustion air into said body from the outer end portion thereof, means for shaping said air into a tubular stream adjacent the discharge end of said delivery pipe, a metallic combustion sleeve coaxial with said delivery pipe and positioned to receive the flow of fuel and the tubular stream of air, said combustion sleeve extending through the full length of said opening and being telescoped within and spaced radially inwardly from the outer end portion of said tube, said combustion sleeve having an inner end extending inwardly beyond the inner side of said wall so as to discharge the fuel/air mixture into said tube beyond said wall, and an abrupt restriction within said sleeve adjacent the inner end thereof and beyond the inner side of said wall to create turbulence within the fuel/air mixture discharged from said sleeve.

2. The combination defined in claim 1 in which said means for shaping said air comprises a coup mounted within said body and located with its open end disposed adjacent the outer end of said sleeve.

3. The combination defined in claim 2 in which said fuel delivery pipe extends into said cup through the closed end thereof and terminates short of the open end of the cup.

4. The combination defined in claim 1 in which said fuel supply means includes first means for supplying a flow of gaseous fuel and second means for alternatively supplying a flow of liquid fuel.

* * * * *